US005321862A

United States Patent [19]

Campbell

[11] Patent Number: 5,321,862

[45] Date of Patent: Jun. 21, 1994

[54] BED MAKING METHOD AND BEDCLOTHES TO ACCOMODATE SAME

[76] Inventor: Katherine Campbell, P.O. Box 217 Main St., Parksville, N.Y. 12768

[21] Appl. No.: 57,115

[22] Filed: May 4, 1993

[51] Int. Cl.[5] ..... A47G 9/04; A47G 9/02

[52] U.S. Cl. ..... 5/482; 5/496; 5/502; 5/923

[58] Field of Search ..... 5/482, 496, 498, 500, 5/502, 923

[56] References Cited

U.S. PATENT DOCUMENTS

| | | | |
|---|---|---|---|
| 2,262,436 | 11/1941 | Cotton | 5/501 |
| 3,083,378 | 4/1963 | Pursell | 5/498 |
| 3,179,958 | 4/1965 | Carris | 5/496 |
| 4,488,323 | 12/1984 | Colburn | 5/460 |
| 5,070,561 | 12/1991 | Keidser | 5/482 |
| 5,072,470 | 12/1991 | Lysiak | 5/496 |
| 5,092,010 | 3/1992 | Wong | 5/496 |
| 5,099,531 | 3/1992 | Schmier | 5/460 |
| 5,208,926 | 5/1993 | Stackhouse | 5/482 |

*Primary Examiner*—Alexander Grosz
*Attorney, Agent, or Firm*—Sandra M. Kotin

[57] ABSTRACT

Bedclothes which have been modified by affixing thereto connecting means which are positioned to guide the placement of the bedclothes on the mattress. When connectors are aligned along the periphery of the mattress, the bedclothes are properly centered and positioned with the correct amount of overhang on three sides. The connectors on one article of bedclothes coact with those on the next layer to position that layer and hold the layers together as a unit. Bedclothes may be removed and replaced as a unit or singly and they may be tucked under the mattress or not as the user dictates. The method of bedmaking utilizing the bedclothes may be performed visually or tactilely.

17 Claims, 2 Drawing Sheets

BED MAKING METHOD AND BEDCLOTHES TO ACCOMODATE SAME

FIELD OF THE INVENTION

The instant invention relates to a modification of standard bedclothes and a method of bedmaking which utilizes the modified bedclothes for ease and expediency in bedmaking and to maintain the proper positioning of the bedclothes on the bed.

BACKGROUND OF THE INVENTION

Bedclothes have remained basically the same since as far back as memory allows. The only new development to reach marketable proportions has been the fitted or contour bottom sheet. This has made bed-making easier and helped to maintain the bed in neater array from day to day. There have been patents issued for a variety of other innovations, but none have been popularly exploited.

Pursell in U.S. Pat. No. 3,083,378 shows a contour sheet with a fastening means such as one half of a zipper attached around three sides. A blanket is constructed similarly to the contour sheet with the other half of the zipper around three sides. When in place, the blanket is fastened to the sheet by means of the zipper. The user is then securely held under the blanket and the bed never gets messed.

Carris, in U.S. Pat. No. 3,179,958, has designed bed sheets with button holes spaced along three sides. Buttons are permanently attached to the mattress and are always visible. Once the sheets are buttoned into place they remain in position and blankets placed atop the sheets will remain essentially stationary. The sheets have a series of holes spaced such that they can be used on mattresses of different sizes.

A similar design of Colburn in U.S. Pat. No. 4,488,323 uses fastener strips such as Velcro ®, one part of which is permanently attached to the mattress and the other part of which is attached to a mattress pad and the top and bottom sheets. The bottom layer, the mattress pad, is the shortest and each successive layer is longer on the sides such that the top sheet attaches at a point lower on the sides of the mattress. The top sheet is secured to the mattress on three sides. The sheets must be individually made for each size bed and cannot be interchanged on beds of different sizes.

Wong, in U.S. Pat. No. 5,092,010, has devised casings which fit over the ends of the mattress. Velcro or other fastening means are spaced along the edges of the casings. A sheet with fasteners attaches to the casings and a bedspread may be attached as well. Casings fitted to a box spring can accomodate a dust ruffle. Sheets and other bedclothes must be specially made to fit only this system and separate sets are needed for beds of different sizes.

Lysiak (U.S. Pat. No. 5,072,470) teaches a device which is placed under a mattress and has clips which grip and hold a sheet, a blanket and a comforter in place at several points around the bed. The holding strips are elastic so there is some give to the bedclothes for greater comfort of the user. The device itself is completely out of sight when properly positioned.

Cotton (U.S. Pat. No. 2,262,436) developed a blanket protector which folds over the blanket at the top and bottom edges. Tapes with snaps are stitched to the blanket on both sides. Snap receivers on the blanket protector coact with the snaps and hold the blanket protector securely in place.

Schmier, in U.S. Pat. No. 5,099,531, teaches the use of fastening means such as buttons firmly attached along the foot of a mattress. Sheets, blankets, comforters, and other covers are made with corresponding buttonholes. The bedclothes will remain in place during use. Fasteners, requiring additional buttonholes in the bedclothers, can also be used at the top edges of the bedclothes to hold them all together. The button holes can be spaced so as to enable the bedclothes to be used on beds of different sizes. The sheets and other bedclothes must be properly positioned before they can be fastened to the buttons and firmly secured at the bottom of the bed. The buttons attached to the mattress are in plain view.

Most of the above methods require that sheets be made specifically for that method, that they cannot be used in any other method, nor can they be used on a conventional bed not fitted or modified for one of the methods. Where buttonholes are required to be made in the bedclothes, additional steps are needed in the manufacturing process and buttonholes provide more sites for wear and tear. The bedclothes are likewise anchored to the mattress, either all around, or at least along the foot of the bed, a condition not always desired. The buttons or fasteners attached to the mattress are readily visible.

BRIEF SUMMARY OF THE INVENTION

Anyone who has ever tried to place a top sheet, blanket or spread on a bed knows that one must move from one side of the bed to the other to be sure the piece is properly centered. This is not so much a problem with a single bed, unless the bed-maker is a child, but the difficulty increases with the bed size.

The instant invention relates to a method of bed making which can be used for any size bed and the bedclothes needed to accomplish the method. The bedclothes are quickly and easily positioned and aligned and any number of layers can be accommodated. A standard bottom or fitted sheet is utilized and there are no additions or modifications to the bottom sheet or any portion of the bed itself.

It is an object of the present invention to provide a method for making a bed which is fast and easy and does not require moving back and forth from one side of the bed to the other and can be accomplished by the young, the elderly and by the handicapped.

Another object of the present invention is to enable a visually handicapped person to make a perfect bed with no assistance.

It is another object of the present invention that nothing is attached to the mattress so that the standard fitted or flat sheets can be used directly atop the mattress.

It is another object of the present invention that all bedclothes can be perfectly aligned, but that none need be tucked under or otherwise secured at the foot or sides of the bed unless the user desires to have them so secured.

Another object is to enable one or more layers of bedclothes to be removed or turned down quickly, even by a person in the bed.

A further object is to make manufacturing simple since conventional sheets can be easily modified by the addition of fasteners.

A still further object of the present invention is that there is no attachment to the mattress and only that portion of the bedclothes need be tucked under as desired by the user.

Another object is to enable the bed to be remade by removing all the covers and the spread in one unit and just changing the sheets. They can then be replaced and properly aligned in one step.

Further objects and advantages of the present invention will become apparent from the description of the preferred embodiments.

DETAILED DESCRIPTION OF THE INVENTION

Conventional bed making consists of placing the bottom sheet on the mattress, positioning it properly and tucking it under the mattress all around on the four sides. If a fitted bottom sheet is used, the process is easier and the sheet need only be pulled into position and the corners fitted over the mattress. The rest of the process involves positioning the top sheet with equal overhang on three sides and tucking under the portion at the foot of the bed and on the sides, if desired. Then the blanket or quilt must be positioned and lastly the bedspread. Each article requires proper placement or there is too much overhang on one side and not enough on the other.

The bedclothes of the instant invention are of the nature of conventional bedclothes, with the addition of mating connectors specifically positioned so as to be used in two ways. First, as markers, to assist in positioning, with the result being that the sheet or cover is centrally aligned and there is equal overhang around the bed. This can be of great assistance to the elderly and those with handicaps that make bending and stretching difficult. Visually handicapped persons need only feel for the connector nearest the corner of the sheet or cover, place that portion over the foot corner of the mattress and line up the outer connectors along the edge of the mattress to make a perfect bed.

Second, the connectors interact with similarly situated connectors on the next layer such that the layers become attached to each other in proper alignment. The connectors can be quickly fastened or unfastened so that one or more layers can be put on or removed very easily. A person in the bed can remove one or more layers without having to get out of bed. Additionally, to make the bed, the blankets and bedspread can be removed and replaced in one unit. This simplifies daily bedmaking when the sheets are not changed, and makes changing the sheets just as simple.

The top sheet and other bedclothes may be left loose, tucked in at the foot of the bed only, or tucked in around three sides. This is at the descretion of the user and is not impeded by the instant method or the bedclothes.

Figure 1:
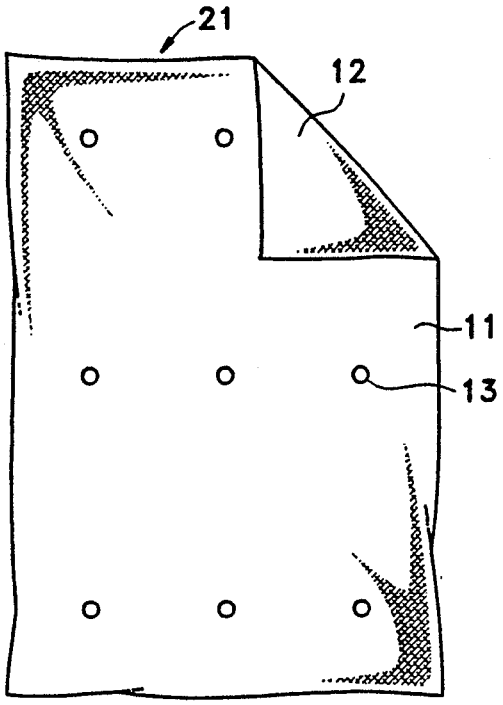
FIG. 1 is a plan view of a top sheet with first mating connectors on the upper side only.

The top sheet 21 is fitted with first mating connectors 13 only, and they are placed on the upper surface 11. The connectors are positioned such that the sheet is properly aligned with equal overhang on the sides when there is a connector at each foot corner of the mattress, and several others along the perimeter. Connectors may also be placed within the central portion to assist in keeping the layers together. Since the top sheet is usually meant to be folded over a blanket or other bed cover, the connectors are placed accordingly to allow for the fold-over at the head of the bed. FIG. 1 shows a top sheet 21 with first mating connectors 13 on the upper surface 11 only. The under surface 12 is in contact with the bottom sheet 23 and is smooth, with no connectors to bother the user.

Figure 2:
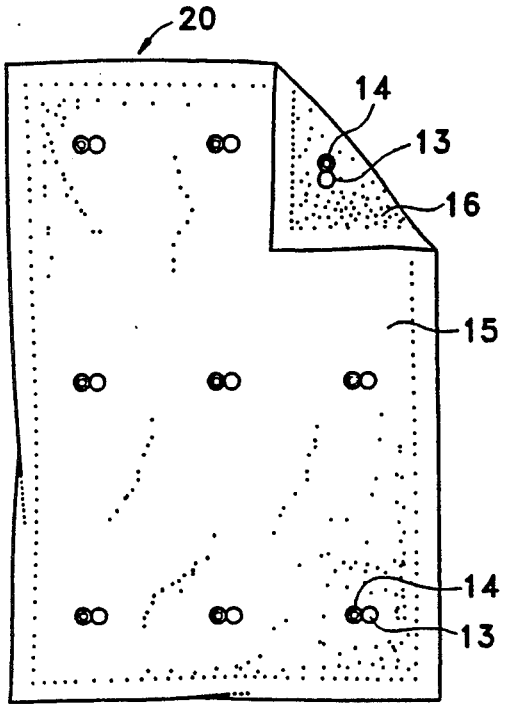
FIG. 2 is a plan view of a bed cover with first and second mating connectors adjacent to each other on both upper and under surfaces.

FIG. 2 is illustrative of any bed cover 20. The bed cover 20 may be a blanket or quilt alone, or a blanket or quilt within a quilt cover or duvet cover. One or more bed covers may be used. Each bed cover 20 is fitted with mating connectors on both the upper surface 15 and the under surface 16. The connectors are positioned as are those on the top sheet 21 for proper placement and alignment. At each of the connector points on the bed covers 20 there is a first mating connector 13 and a second mating connector 14 adjacent to each other. This makes both sides of the bed cover 20 equivalent so that either side can be placed adjacent the top sheet 21, and also enables several layers of bed covers to be placed on the bed without the user having to be concerned about which side must be placed up or down.

The bedspread 19 is made with connectors on the under surface 18 only. There are no connectors on the upper surface 17 of the bedspread 19. As with the top sheet 21 only one connector is used at each point, but these are second mating connectors 14. Thus, the spread may be used atop any bed cover 20 or directly on the top sheet 21 as in summer, when no other bed covers may be needed.

Figure 3:
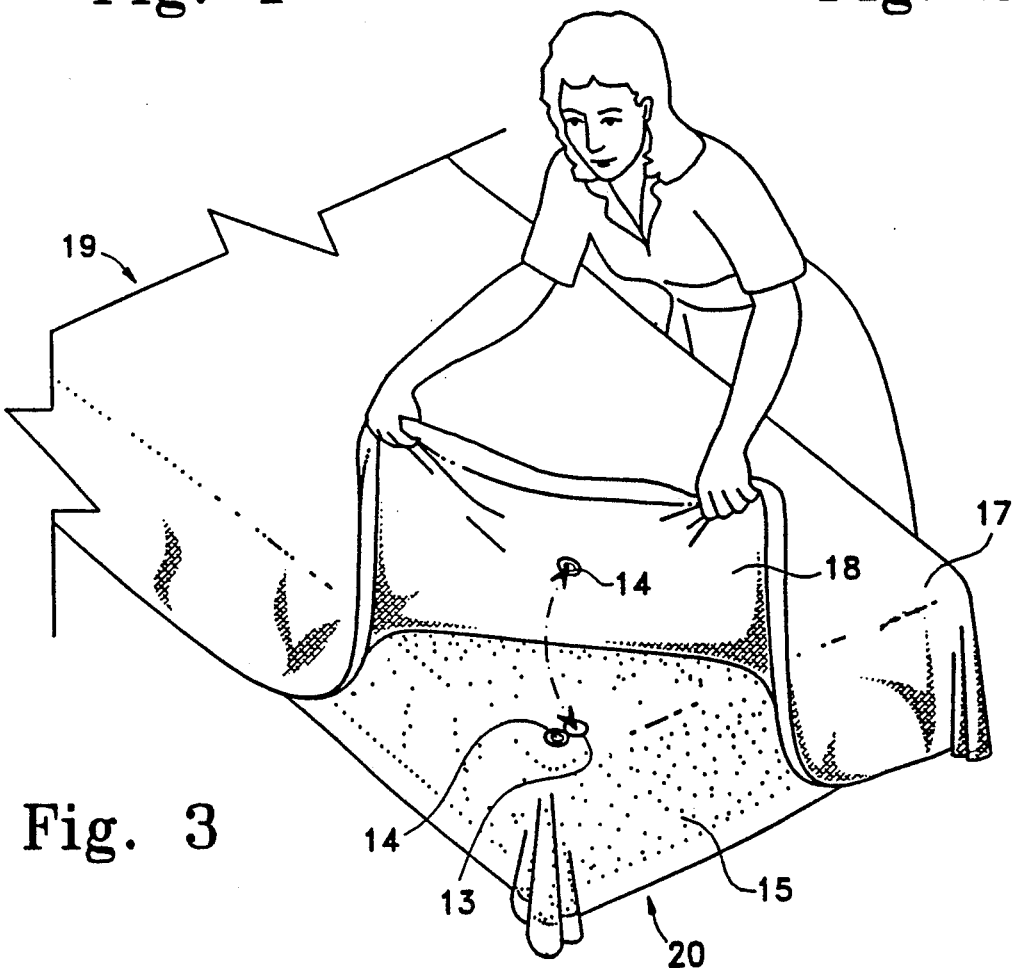
FIG. 3 is a perspective view of a person making a bed with the bed cover properly positioned by having the mating connectors at the corners of the mattress and the bedspread being positioned and fastened to the bed cover.

FIG. 3 shows a person making a bed. A bed cover 20 has been properly positioned and the person is now positioning the bedspread 19 and placing the second mating connector 14 on the bedspread 19 in contact with the first mating connector 13 on the bed cover 20. The bed cover 20 has not been tucked in or otherwise fastened to the bed or mattress.

Figure 4:
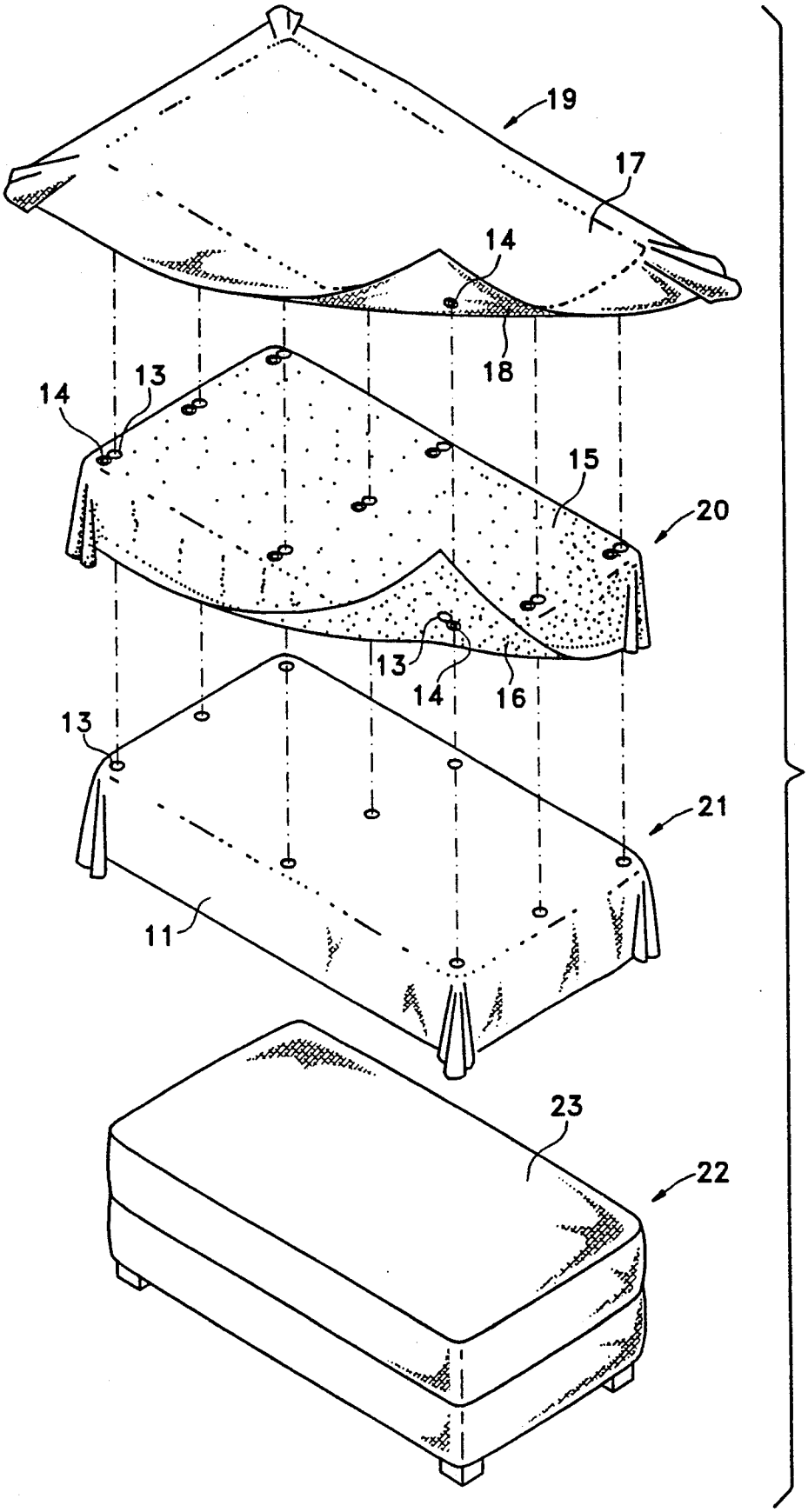
FIG. 4 is an exploded view of a bed with fitted bottom sheet, top sheet, bed cover and bedspread all aligned by positioning the mating connectors.

The top sheet 21, bed cover 20 and bedspread 19 can be aligned and placed on a bed 22 which has already received a fitted bottom sheet 23, as can be seen in FIG. 4.

The method and bedclothes of the present invention are not only time savers for the busy homemaker, but can be utilized in hospitals and nursing homes. Their use in hotels and motels can greatly reduce the time spent by the housekeeping staff in bedmaking. In large hotels with hundreds of beds to be made each day, such a time factor can be important. The method can also save much bending and stretching since placement of the bed clothes is facilitated by the use of the connectors as markers.

Many visually handicapped persons live alone and take care of their own needs. This method and bedclothes is another way to make the task of bedmaking easier and to predetermine its outcome.

The connectors can be snaps and snap receivers or hook-and-loop type fasteners such as those known commercially as 'Velcro'. If snaps and snap receivers are used, they can be of a plastic material or nylon so as not to feel cold to the touch.

Commercially, no special changes need be made in the method of manufacture of sheets and other bedclothes. The connectors would be applied after the sheets and bedclothes are manufactured in the conventional manner.

The connectors can be applied to sheets fitting any size bed. More rows of connectors may be used on the larger sheets to better maintain the layers in alignment without wrinkles or bulges.

While one embodiment of the present invention has been illustrated and described in detail, it is to be understood that this invention is not limited thereto and may be otherwise practiced within the scope of the following claims.

I claim:

1. Bedclothes adapted for ease of placement and alignment atop a mattress having a flat top surface, a head end, a foot end, a right side and a left side, said bedclothes comprising;

(a) a top sheet having an under surface and an upper surface, said top sheet being dimensioned with a portion covering the top surface of the mattress and having an outer peripheral edge overhanging said mattress on the right side, left side, and foot end;

(b) a plurality of connecting means permanently affixed to the upper surface of the top sheet and disposed about the portion of the top sheet covering the top surface of the mattress;

(c) a bed cover selected from the group consisting of blankets, quilts, quilt covers and duvet covers, said bed cover having an under surface and an upper surface, said bed cover being dimensioned with a portion covering the top surface of the mattress and having an outer peripheral edge overhanging said mattress on the right side, left side, and foot end;

(d) a plurality of connecting means permanently affixed to the under surface of said bed cover and to corresponding positions on the upper surface of the bed cover, said connectors disposed about the portion of the bed cover covering the top surface of the mattress;

(e) a bedspread having an under surface and an upper surface, said bedspread being dimensioned with a portion covering the top surface of the mattress and having an outer peripheral edge overhanging said mattress on the right side, left side, and foot end and extending beyond the head end of the mattress;

(f) a plurality of connecting means permanently affixed to the under surface of the bedspread, said connectors disposed about the portion of the bedspread covering the top surface of the mattress;

the connectors on the upper surface of the top sheet being capable of coaction with the connectors on the under surface of the bed cover, and the connectors on the upper surface of the bed cover being capable of coaction with the connectors on the under surface of the bedspread; and said connecting means being guides for proper positioning and alignment of the bedclothes atop the mattress.

2. Bedclothes adapted for ease of positioning and alignment atop a mattress having a flat top surface, a head end, a foot end with opposing corners, a right side and a left side, said bedclothes comprising;

(a) a top sheet having an under surface and an upper surface, said top sheet being dimensioned with a portion covering the top surface of the mattress and having an outer peripheral edge overhanging said mattress on the right side, left side, and foot end;

(b) a plurality of connecting means permanently affixed to the upper surface of the top sheet and disposed about the portion of the top sheet covering the upper surface of the mattress such that at least two of said connectors are positioned over the opposing corners of the foot end of the mattress, at least two connectors are positioned above and along the periphery of the right side of the mattress, and at least two connectors are positioned above and along the periphery of the left side of the mattress;

(c) a bed cover selected from the group consisting of blankets, quilts, quilt covers and duvet covers, said bed cover having an under surface and an upper surface, and said bed cover being dimensioned with a portion covering the top surface of the mattress and having an outer peripheral edge overhanging said mattress on the right side, left side, and foot end;

(d) a plurality of connecting means permanently affixed to the under surface of said bed cover and to corresponding positions on the upper surface of the bed cover, said connectors disposed about the portion of the bed cover covering the top surface of the mattress such that at least two of said connectors are positioned over opposing corners of the foot end of the mattress, at least two connectors are positioned above and along the periphery of the right side of the mattress, and at least two connectors are positioned above and along the periphery of the left side of the mattress;

(e) a bedspread having an under surface and an upper surface, said bedspread being dimensioned with a portion covering the top surface of the mattress and having an outer peripheral edge overhanging said mattress on the right side, left side, and foot end and extending beyond the head end of the mattress;

(f) a plurality of connecting means permanently affixed to the under surface of the bedspread, said connectors disposed about the portion of the bedspread covering the top surface of the mattress such that at least two of said connectors are positioned over opposing corners of the foot end of the mattress, at least two connectors are positioned above and along the periphery of the right side of the mattress and at least two connectors are positioned above and along the periphery of the left side of the mattress;

the connectors on the upper surface of the top sheet being capable of coaction with the connectors on the under surface of the bed cover and the connectors on the under surface of the bedspread, and the connectors on the upper surface of the bed cover being capable of coaction with the connectors on the under surface of the bedspread; and said connecting means being guides for proper positioning and alignment of the bedclothes atop the mattress.

3. Bedclothes as in claim 2 wherein the connecting means permanently affixed to the upper surface of the top sheet are first mating connectors.

4. Bedclothes as in claim 2 wherein the connecting means permanently affixed to the upper surface and under surface of the bed cover are pairs of first mating connector and second mating connector such that either surface of the bed cover can be placed on the top sheet.

5. Bedclothes as in claim 2 wherein the connecting means permanently affixed to the under surface of the bedspread are second mating connectors.

6. Bedclothes as in claim 2 wherein the connecting means permanently affixed to the upper surface of the top sheet are hook-type fasteners.

7. Bedclothes as in claim 2 wherein the connecting means permanently affixed to the under surface and upper surface of the bed cover are pairs of hook-type fastener and loop-type fastener such that either surface of the bed cover can be placed on the top sheet.

8. Bedclothes as in claim 2 wherein the connecting means permanently affixed to the under surface of the bedspread are loop-type fasteners.

9. Bedclothes as in claim 2 wherein the connecting means permanently affixed to the upper surface of the top sheet are snaps.

10. Bedclothes as in claim 2 wherein the connecting means permanently affixed to the upper surface and under surface of the bed cover are pairs of snap and snap receiver such that either surface of the bed cover can be placed on the top sheet.

11. Bedclothes as in claim 2 wherein the connecting means permanently affixed to the under surface of the bedspread are snap receivers.

12. Bedclothes as in claim 10 wherein the snaps and snap receivers are made of a polymeric material.

13. A method for making a bed having a mattress, with a head end, foot end with opposing corners, right side and left side, and being covered with a bottom sheet, said method comprising:

(a) placing and positioning a top sheet on the mattress, said top sheet having connecting means specifically disposed on its upper surface such that when said connecting means are placed along the periphery of the right and left sides and at the opposing corners of the foot end of the mattress said top sheet is properly positioned with overhang on the foot end, right end and left ends of the mattress;

(b) placing, positioning and connecting a bed cover onto the top sheet, said bed cover having connecting means specifically disposed on its upper surface and under surface such that when said connecting means are placed about the periphery of the right and left sides and at the opposing corners of the foot end of the mattress the under surface connecting means are in coaction with the connecting means of the top sheet, and the bed cover is properly positioned with overhang on the foot end, right end and left ends of the mattress;

(c) placing, positioning and connecting a bedspread onto the bed cover, said bedspread having connecting means specifically disposed on its under surface such that when said connecting means are placed about the periphery of the right and left sides and at the opposing corners of the foot end of the mattress they are in coaction with the connecting means on the upper surface of the bed cover, and the bedspread is properly positioned with overhang on the foot end, right and left ends of the mattress and at the head end of the mattress;

(d) placing pillows along the head end of the mattress and folding the head end overhang of the bedspread over the pillows.

14. A bedmaking method as in claim 13 wherein the positioning of the top sheet, bed cover and bedspread is achieved by visual placement of the connecting means about the periphery of the right side, left side and opposing corners of the foot end of the mattress.

15. A bedmaking method as in claim 13 wherein the positioning of the top sheet, bed cover and bedspread is achieved by tactile placement of the connecting means about the periphery of the right side, left side and opposing corners of the foot end of the mattress.

16. A bedmaking method as in claim 13 further incorporating the step of placing, positioning and connecting a second bed cover over the first bed cover such that the connecting means on the upper surface of the first bed cover can coact with the connecting means on the under surface of the second bed cover.

17. A bedmaking method as in claim 13 further comprising the step of tucking a portion of the top sheet and bed cover under the mattress.

* * * * *